US011445887B2

(12) United States Patent
Singhal et al.

(10) Patent No.: US 11,445,887 B2
(45) Date of Patent: Sep. 20, 2022

(54) ADJUSTABLE RACK ASSEMBLY AND DISHWASHING APPLIANCE

(71) Applicant: Haier US Appliance Solutions, Inc., Wilmington, DE (US)

(72) Inventors: Arpit Singhal, Uttar Pradesh (IN); Justin Paul Mudd, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/108,520

(22) Filed: Dec. 1, 2020

(65) Prior Publication Data

US 2022/0167828 A1 Jun. 2, 2022

(51) Int. Cl.
*A47L 15/50* (2006.01)
*A47L 15/42* (2006.01)

(52) U.S. Cl.
CPC ..... *A47L 15/507* (2013.01); *A47L 15/504* (2013.01)

(58) Field of Classification Search
CPC ..... A47L 15/507; A47L 15/504
See application file for complete search history.

(56) References Cited

U.S. PATENT DOCUMENTS 3,726,580 A * 4/1973 Guth ..... A47B 88/407 312/351
3,809,450 A * 5/1974 Guth ..... A47L 15/504 312/351
3,822,085 A * 7/1974 Clark ..... A47B 88/407 312/351
5,474,378 A 12/1995 Smith et al.
7,168,578 B2 1/2007 Mersch et al.
7,410,228 B2 8/2008 Dickson et al.
7,418,967 B2 9/2008 Kim
7,651,180 B2 1/2010 Deiss et al.
7,775,378 B2 8/2010 Tynes et al.
8,191,560 B2 6/2012 Mallory et al.
8,192,557 B2 6/2012 Ryu et al.
8,534,471 B2 9/2013 Wong et al.
9,579,009 B2 2/2017 Bhajak et al.
10,022,037 B2 7/2018 Kutto et al.
10,136,795 B2 11/2018 Nowell, Jr. et al.
(Continued)

FOREIGN PATENT DOCUMENTS

EP 1136030 A1 * 9/2001 ..... A47L 15/504
WO WO2018/202368 A1 11/2018

*Primary Examiner* — Kimberley S Wright
(74) *Attorney, Agent, or Firm* — Dority & Manning, P.A.

(57) ABSTRACT

A dishwashing appliance or rack assembly may include a rack, a front bracket, a rear bracket, and a joiner bar. The rack may include a sidewall having a transverse rail and slide in a transverse direction between an extended position and a retracted position. The front bracket may be attached to the sidewall and extend vertically between a fixed end secured to the sidewall and a free end laterally pivotable apart from the transverse rail. The rear bracket may be attached to the sidewall rearward from the front bracket. The rear bracket may extend vertically from a fixed end secured to the sidewall to a free end laterally pivotable apart from the transverse rail. The joiner bar may extend along the transverse direction from the front bracket to the rear bracket and be laterally translatable relative to the transverse rail to motivate the free end of the front bracket.

20 Claims, 12 Drawing Sheets

(56) References Cited

U.S. PATENT DOCUMENTS

| | | | | |
|---|---|---|---|---|
| 10,582,829 | B2 | 3/2020 | Hansen et al. | |
| 10,595,707 | B2 * | 3/2020 | Singhal | A47B 88/493 |
| 10,602,909 | B2 | 3/2020 | Gupta et al. | |
| 2003/0075517 | A1 * | 4/2003 | Jahrling | A47L 15/504 211/41.8 |
| 2011/0018410 | A1 | 1/2011 | Bastuji et al. | |
| 2014/0217868 | A1 * | 8/2014 | Bhajak | A47L 15/50 312/228.1 |
| 2016/0331204 | A1 * | 11/2016 | Kutto | A47L 15/504 |
| 2019/0125161 | A1 * | 5/2019 | Hansen | A47L 15/46 |
| 2019/0269297 | A1 * | 9/2019 | Gupta | A47B 57/26 |
| 2019/0350434 | A1 * | 11/2019 | Singhal | A47L 15/503 |
| 2021/0244258 | A1 * | 8/2021 | Elkhoury | A47L 15/504 |

* cited by examiner

ADJUSTABLE RACK ASSEMBLY AND DISHWASHING APPLIANCE

FIELD OF THE INVENTION

The present subject matter relates generally to rack assemblies for appliances, such as dishwasher appliances.

BACKGROUND OF THE INVENTION

Various appliances have slidable rack assemblies for holding articles therein. For example, a dishwasher appliance is typically provided with one or more rack assemblies into which various articles may be loaded for cleaning. The rack assemblies may include features such as, for example, tines that hold and orient the articles to receive sprays of wash and rinse fluids during the cleaning process. The articles to be cleaned may include a variety of dishes, cooking utensils, silverware, and other items.

The size of the articles can vary significantly. For example, glasses are available in a variety of different heights. Dishes are manufactured with various diameters between large and small. Pots used for cooking can have different depths.

In order to accommodate the larger articles, some dishwasher appliances include an upper rack assembly of a dishwasher appliance with features for height adjustment of the rack assembly. Such adjustability allows for movement of the upper rack assembly along a vertical direction V. By moving or lifting the upper rack to a higher vertical height setting, larger articles can be accommodated in, for example, a lower rack assembly positioned beneath the upper rack assembly. Conversely, by lowering the upper rack to a lower vertical height setting, larger articles can be accommodated in, for instance, the upper rack assembly.

Certain adjustment features have been proposed for providing height adjustability for a rack assembly. Typically, these features include multiple moving parts that may require the user to engage or move both the rack assembly and the adjustment features at the same time as the user lifts or lowers the rack assembly. For certain users, these adjustment features can be difficult to operate.

Some conventional adjustment features for rack assemblies require a rack to move uniformly from one height to the next. Specifically, the rack is forced to remain horizontal as it is raised or lowered. Nonetheless, certain articles may be difficult to load in such an orientation, irrespective of the height.

Accordingly, a rack assembly for an appliance that can be easily adjusted to different vertical positions would be useful. Moreover, a rack assembly for an appliance that can be easily adjusted to different vertical positions while being tiltable to accommodate various articles would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a rack assembly is provided. The rack assembly may include a rack, a front bracket, a rear bracket, and a joiner bar. The rack may include a sidewall having a transverse rail. The rack may be slidable in a transverse direction between an extended position and a retracted position. The front bracket may be attached to the sidewall. The front bracket may extend vertically between a fixed end secured to the sidewall and a free end laterally pivotable apart from the transverse rail to permit vertical movement of the rack relative to the front bracket. The rear bracket may be attached to the sidewall rearward from the front bracket. The rear bracket may extend vertically from a fixed end secured to the sidewall to a free end laterally pivotable apart from the transverse rail to permit vertical movement of the rack relative to the rear bracket. The joiner bar may extend along the transverse direction from the front bracket to the rear bracket. The joiner bar may be vertically offset from the fixed end of the front bracket. The joiner bar may be laterally translatable relative to the transverse rail to motivate the free end of the front bracket.

In another exemplary aspect of the present disclosure, a dishwashing appliance is provided. The dishwashing appliance may include a cabinet, a tub, and an elevated rack assembly. The tub may define a wash chamber within the cabinet, The elevated rack assembly may be mounted to the tub. The elevated rack assembly may include a frame, a rack, a front bracket, a rear bracket, and a joiner bar. The frame may be positioned within the wash chamber. The rack may include a sidewall having a transverse rail. The rack may be mounted to the frame to receive articles for washing. The rack may be slidable along the frame in a transverse direction between an extended position and a retracted position. The front bracket may be attached to the sidewall. The front bracket may support the rack on the frame. The front bracket may extend vertically between a fixed end secured to the sidewall and a free end laterally pivotable apart from the transverse rail to permit vertical movement of the rack relative to the front bracket. The rear bracket may be attached to the sidewall rearward from the front bracket. The rear bracket may support the rack on the frame. The rear bracket may extend vertically from a fixed end secured to the sidewall to a free end laterally pivotable apart from the transverse rail to permit vertical movement of the rack relative to the rear bracket. The joiner bar may extend along the transverse direction from the front bracket to the rear bracket. The joiner bar may be vertically offset from the fixed end of the front bracket. The joiner bar may be laterally translatable relative to the transverse rail to motivate the free end of the front bracket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
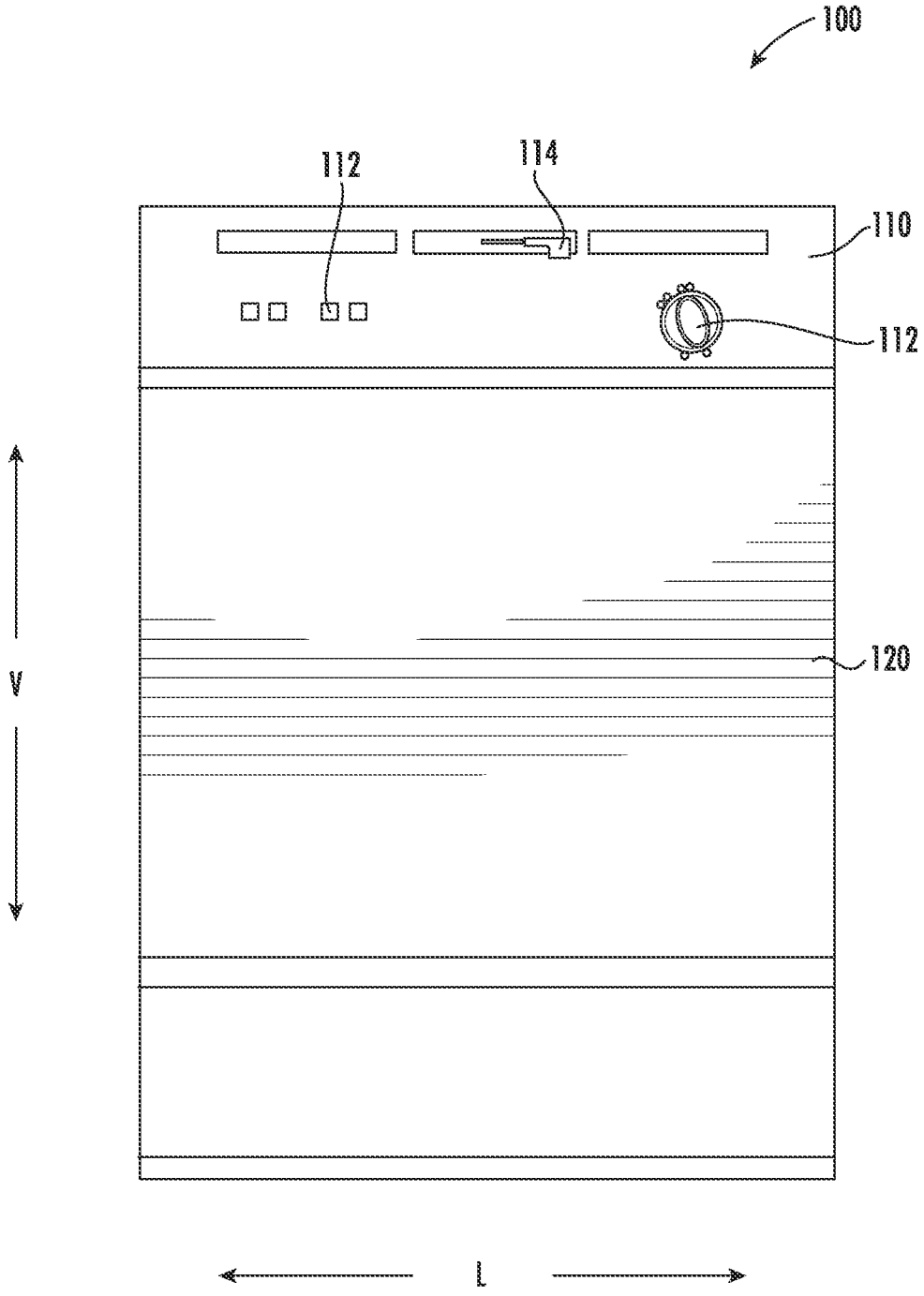
FIG. 1 provides a front elevation view of a dishwashing appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "first," "second," and "third" may be used interchangeably to distinguish one component from another and are not intended to signify location or importance of the individual components. The term "or" is generally intended to be inclusive (i.e., "A or B" is intended to mean "A or B or both"). Furthermore, as used herein, terms of approximation, such as "approximately," "substantially," or "about," refer to being within a ten percent margin of error.

Figure 2:
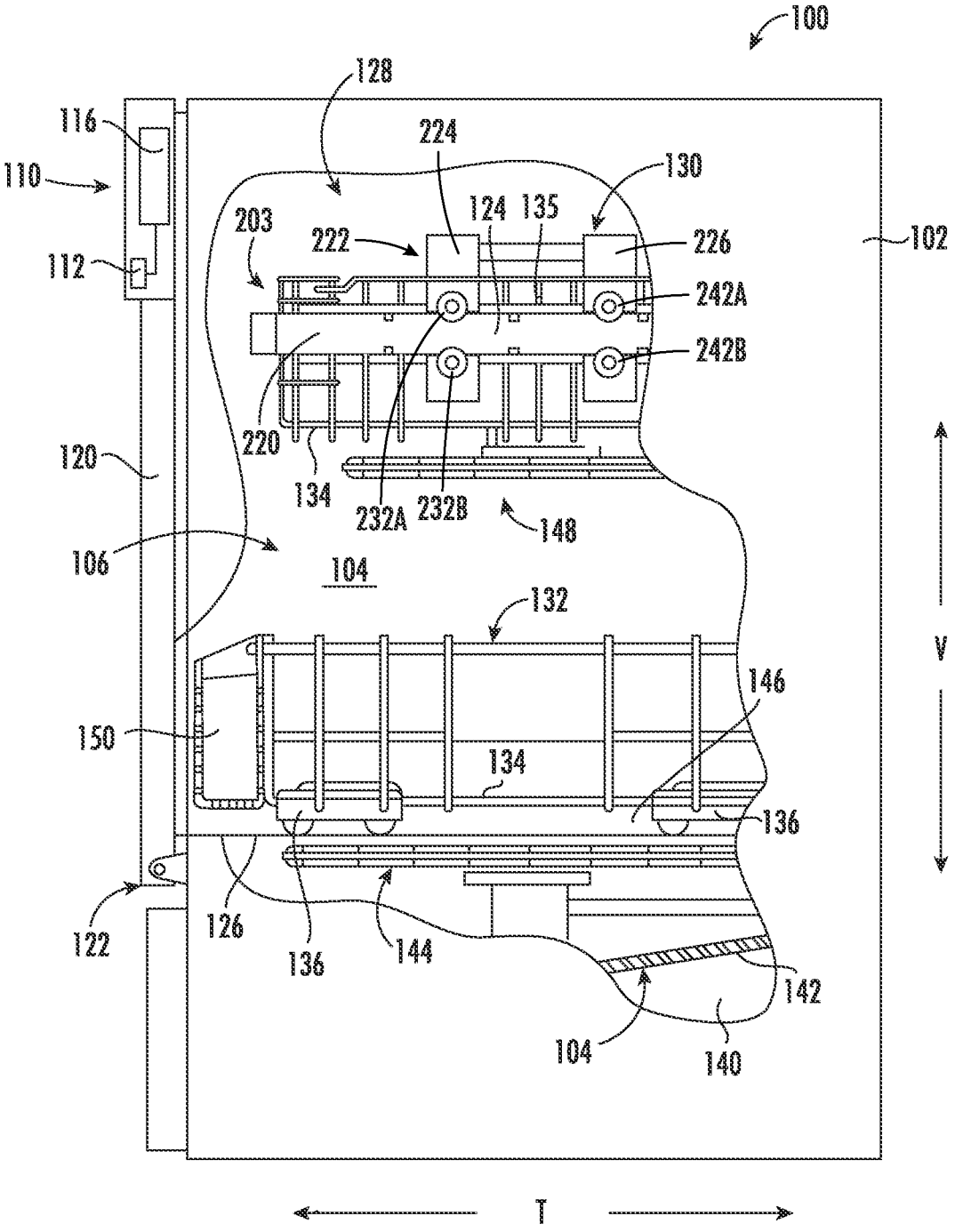
FIG. 2 provides a partial, sectional view of the exemplary dishwasher appliance of FIG. 1.

Turning now to the figures, FIGS. 1 and 2 depict a dishwasher appliance 100 according to an exemplary embodiment of the present disclosure. Dishwasher appliance 100 defines a vertical direction V, a lateral direction L (FIG. 1), and a transverse direction T (FIG. 2). The vertical, lateral, and transverse directions V, L, and T are mutually perpendicular and form an orthogonal direction system.

Dishwasher appliance 100 also includes a cabinet 102 (or chassis) having a tub 104 therein that defines a wash chamber 106. The tub 104 includes a front opening and a door 120 hinged at its bottom 122 for movement between a normally closed vertical position (shown in FIGS. 1 and 2), wherein the wash chamber 106 is sealed shut for washing operation, and a horizontal open position for loading and unloading of articles from dishwasher appliance 100. In some embodiments, a latch 114 is used to lock and unlock door 120 for access to chamber 106.

Slide assemblies 124 are mounted on opposing tub sidewalls 128 to support and provide for movement for a rack assembly 130 (e.g., upper rack assembly 130). In some embodiments, lower guides 126 are positioned in opposing manner of the sides of chamber 106 and provide a ridge or shelf for roller assemblies 136 so as to support and provide for movement of lower rack assembly 130 132. Each of the upper and lower rack assemblies 130, 132 is include a rack (e.g., rack 210) fabricated into lattice structures including a plurality of elongated members 134 and 135 that extend in lateral (L), transverse (T), or vertical (V) directions. Each rack assembly 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assemblies 124 and roller assemblies 136 that carry rack assemblies 130 and 132, respectively. Optionally, a silverware basket 150 may be removably attached to the lower rack assembly 132 for placement of silverware, small utensils, and the like, that are too small to be accommodated by the upper and lower racks 130, 132.

The dishwasher appliance 100 further includes a lower spray assembly 144 that is rotatably mounted within a lower region 146 of the wash chamber 106 and above a tub sump portion 142 so as to rotate in relatively close proximity to the lower rack 132. A mid-level spray assembly 148 is located in an upper region of the wash chamber 106 and may be located in close proximity to upper rack 130. Additionally, an upper spray assembly (not shown) may be located above the upper rack 130.

The lower and mid-level spray assemblies 144, 148 and the upper spray assembly are fed by a fluid circulation assembly for circulating water and wash fluid in the tub 104. Portions of the fluid circulation assembly may be located in a machinery compartment 140 located below the bottom sump portion 142 of the tub 104, as generally recognized in the art. Each spray assembly includes an arrangement of discharge ports or orifices for directing washing liquid onto dishes or other articles located in the upper and lower racks 130, 132, respectively. The arrangement of the discharge ports in at least the lower spray assembly 144 provides a rotational force by virtue of washing fluid flowing through the discharge ports. The resultant rotation of the lower spray assembly 144 provides coverage of dishes and other articles with a washing spray.

Dishwasher appliance 100 is further equipped with a controller 116 to regulate operation of dishwasher appliance 100. Controller 116 may include a memory (e.g., non-transitive memory) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. In certain embodiments, the controller 116 includes a user interface panel 112 through which a user may select various operational features and modes and monitor progress of the dishwasher appliance 100. In one embodiment, user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. User interface 112 may include a display component, such as a digital or analog display device designed to provide operational feedback to a user. User interface 112 may be in communication with controller 116 via one or more signal lines or shared communication busses.

It should be appreciated that the invention is not limited to any particular style, model, or configuration of dishwasher appliance. Thus, the exemplary embodiment depicted in FIGS. 1 and 2 is for illustrative purposes only. For example, different locations may be provided for a user interface 112, different configurations may be provided for rack assemblies 130 and 132, and other differences may be applied as well.

Turning generally to FIGS. 2 through 12, dishwasher appliance 100 includes one or more features for permitting easy adjustment or movement of rack 210 to different heights (i.e., height settings) along the vertical direction V such that rack 210 may be placed in various predetermined positions along the vertical direction V. As described herein, the vertical direction V, lateral direction L, and transverse direction T described with respect to various elements of rack assembly 130 are, except as otherwise indicated, generally understood to correspond to the position of those elements when rack assembly 130 is mounted within wash chamber 106 and to the rest of appliance 100 (e.g., such that rack 210 can slide along a frame 220 in or along the transverse direction T).

It is noted that although adjustable rack assembly 130 is described as an upper rack assembly 130, alternative embodiments may include the adjustable rack assembly 130 at another suitable location (e.g., as a lower rack assembly 130). Moreover, although described within the context of a dishwasher appliance, the present disclosure may be utilized in any other suitable appliance, such as a refrigerator appliance.

As show, dish rack 210 includes a one or more walls (e.g., sidewalls 212 and 214 or bottom wall 216 formed by lattice members) that define a rack cavity 218 for the receipt of articles therein. In particular, a pair of lateral sidewalls 212 extend from the bottom wall 216 at opposite lateral sides of dish rack 210. Each lateral sidewall 212 includes at least one transverse rail 234 (e.g., wire, rod, etc.) that extends along the transverse direction T (e.g., between a front end 202 and a rear end 204 of dish rack 210). At each lateral sidewall 212, a discrete bracket assembly 222 is provided. For the purposes of clarity, a single bracket assembly 222 having a discrete front bracket 224 and rear bracket 226 is generally described herein. Nonetheless, it is understood that a pair of bracket assemblies 222 may be provided with an identical or mirrored bracket assembly 222 on each of the opposite lateral sidewalls 212.

When assembled, rack assembly 130 is attached (e.g., slidably attached) to a frame 220 mounted to tub 104 such that a dish rack 210 is permitted to move along the transverse direction T (e.g., between an extended position and a retracted position) irrespective of a height or vertical position of the dish rack 210. Generally, a frame 220 of a slide assembly 124 may be mounted within wash chamber 106 at each lateral sidewall 128 of wash chamber 106. As would be understood, each frame 220 may include includes a pair of mated rails, such as a first rail that is fixed within wash chamber 106 (e.g., mounted to a sidewall 128 of wash chamber 106) and a second rail that is slidably attached to the first rail (e.g., to slide along the transverse direction T).

In exemplary embodiments, one or more wheels are provided on a frame 220 of a corresponding slide assembly (e.g., slide assembly 124). For instance multiple rows of wheels may bound a frame 220 of a corresponding slide assembly (e.g., slide assembly 124).

In some embodiments, a set of front wheels is provided on rack 210 (e.g., at each lateral side of rack 210). For instance, the set of front wheels may include a first front wheel 232A and a second front wheel 232B at the same lateral side of rack 210. First front wheel 232A may be disposed above frame 220 while second front wheel 232B is mounted below frame 220. Each wheel of the set of front wheels 232A, 232B may be attached to rack 210. For example, each wheel 232A, 232B may be rotatably attached to front bracket 224 (e.g., a bracket body 240 thereof) to rotate about a unique rotation axis. Each rotation axis of front wheels 232A, 232B may be parallel to the other rotation axis of front wheels 232B, 232A and, in certain embodiments, parallel to the lateral direction L (e.g., when rack 210 is mounted within wash chamber 106 and on frame 220).

In additional or alternative embodiments, a set of rear wheels is provided on rack 210 (e.g., at each lateral side of rack 210). For instance, the set of rear wheels may include a first rear wheel 242A and a second rear wheel 242B at the same lateral side of rack 210. First rear wheel 242A may be disposed above frame 220 while second rear wheel 242B is mounted below frame 220. Each wheel of the set of rear wheels 242A, 242B may be attached to rack 210. For example, each wheel 242A, 242B may be rotatably attached to rear bracket 226 (e.g., a bracket body 240 thereof) to rotate about a unique rotation axis. Each rotation axis of rear wheels 242A, 242B may be parallel to the other rotation axis of rear wheels 242B, 242A and, in certain embodiments, parallel to the lateral direction L (e.g., when rack 210 is mounted within wash chamber 106 and on frame 220).

As illustrated, the set of rear wheels 242A, 242B is generally spaced apart from (e.g., rearward relative to) the set of front wheels 232A, 232B in or along the transverse direction T. Each rear wheel 242A, 242B may be transversely aligned with a corresponding front wheel 232A, 232B (e.g., parallel to the transverse direction T such that each rotation axis of a rear wheel 242A, 242B is orthogonal to a common line extending along the transverse direction T to a corresponding front wheel 232A, 232B). When rack 210 is mounted on frame 220, at least one rear wheel 242A, 242B may thus further support rack 210 on frame 220. First rear wheel 242A may be transversely aligned with first front wheel 232A. Second rear wheel 242B may be transversely aligned with second front wheel 232B. A transverse spacing may be defined between each transversely-aligned pair of front and rear wheels from the rotation axis of a front wheel to the rotation axis of the transversely-aligned rear wheel). Optionally, the transverse spacing between each transversely-aligned pair of wheels may be equal.

Figure 3:
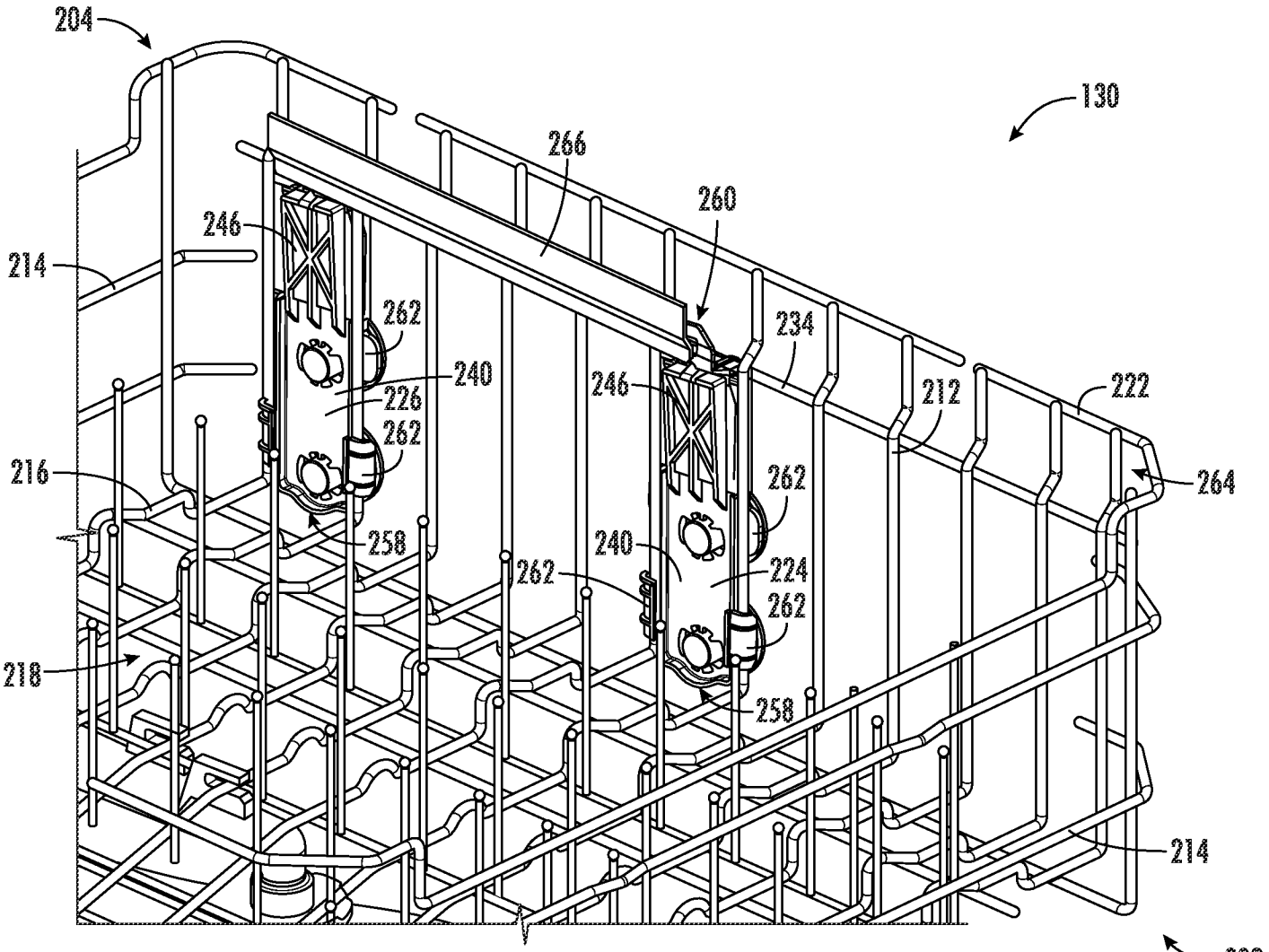
FIG. 3 provides a partial, perspective view of an adjustable rack assembly of an exemplary dishwasher appliance, the rack assembly being in an elevated position.
Figure 4:
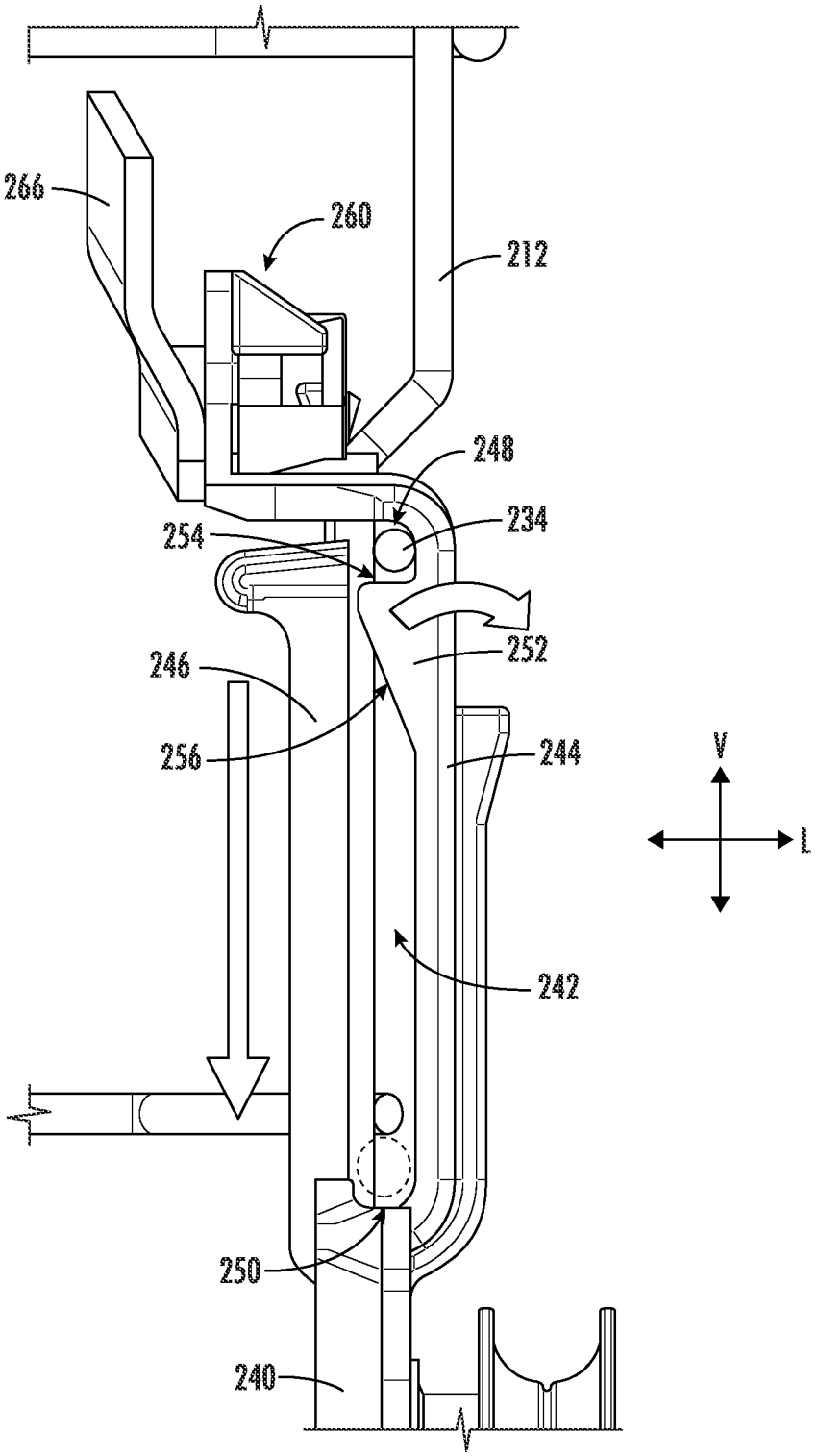
FIG. 4 provides a sectional view of a portion of the exemplary rack assembly of FIG. 3.
Figure 5:
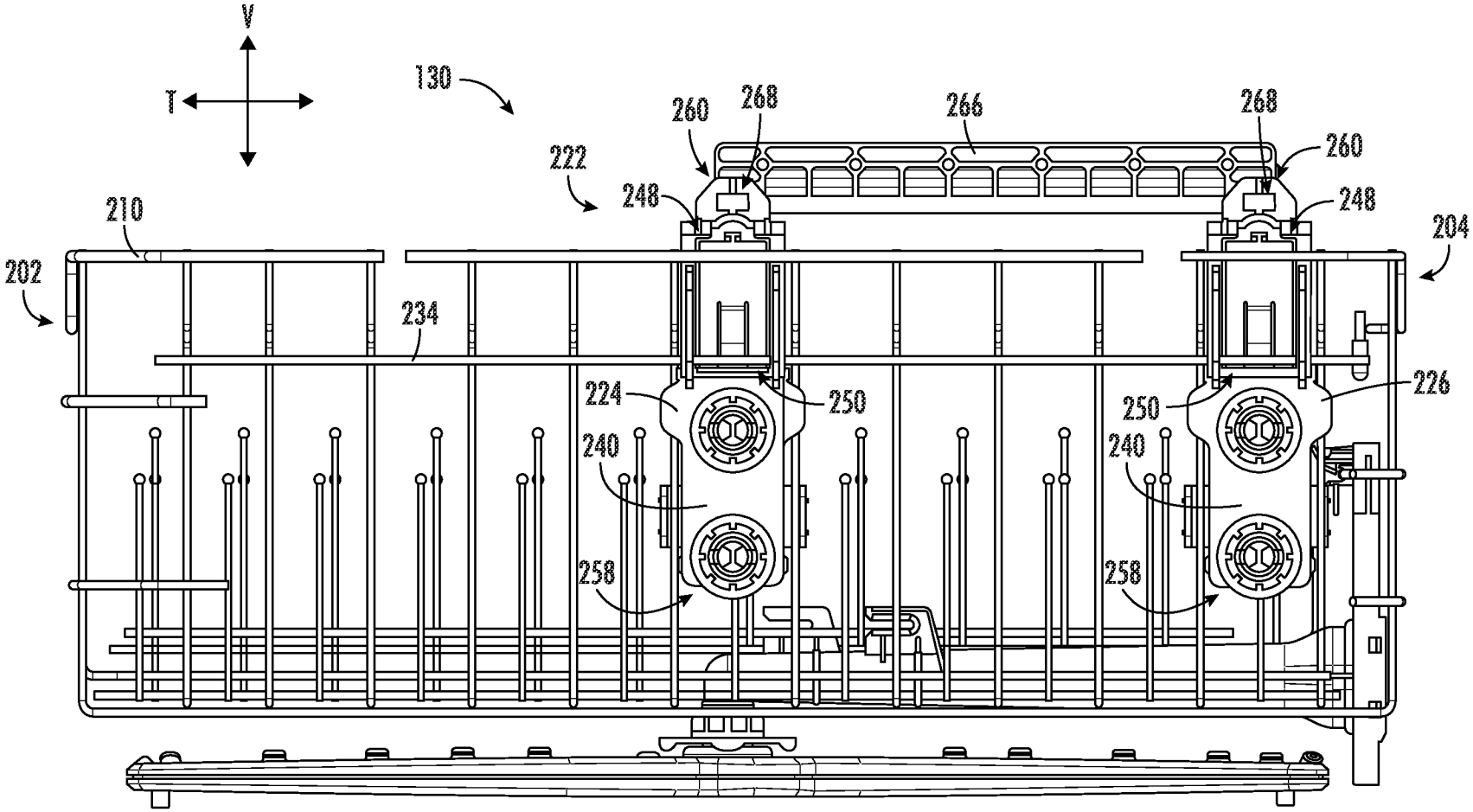
FIG. 5 provides a side elevation view of the exemplary rack assembly of FIG. 3, the rack assembly being in a lowered position.
Figure 6:
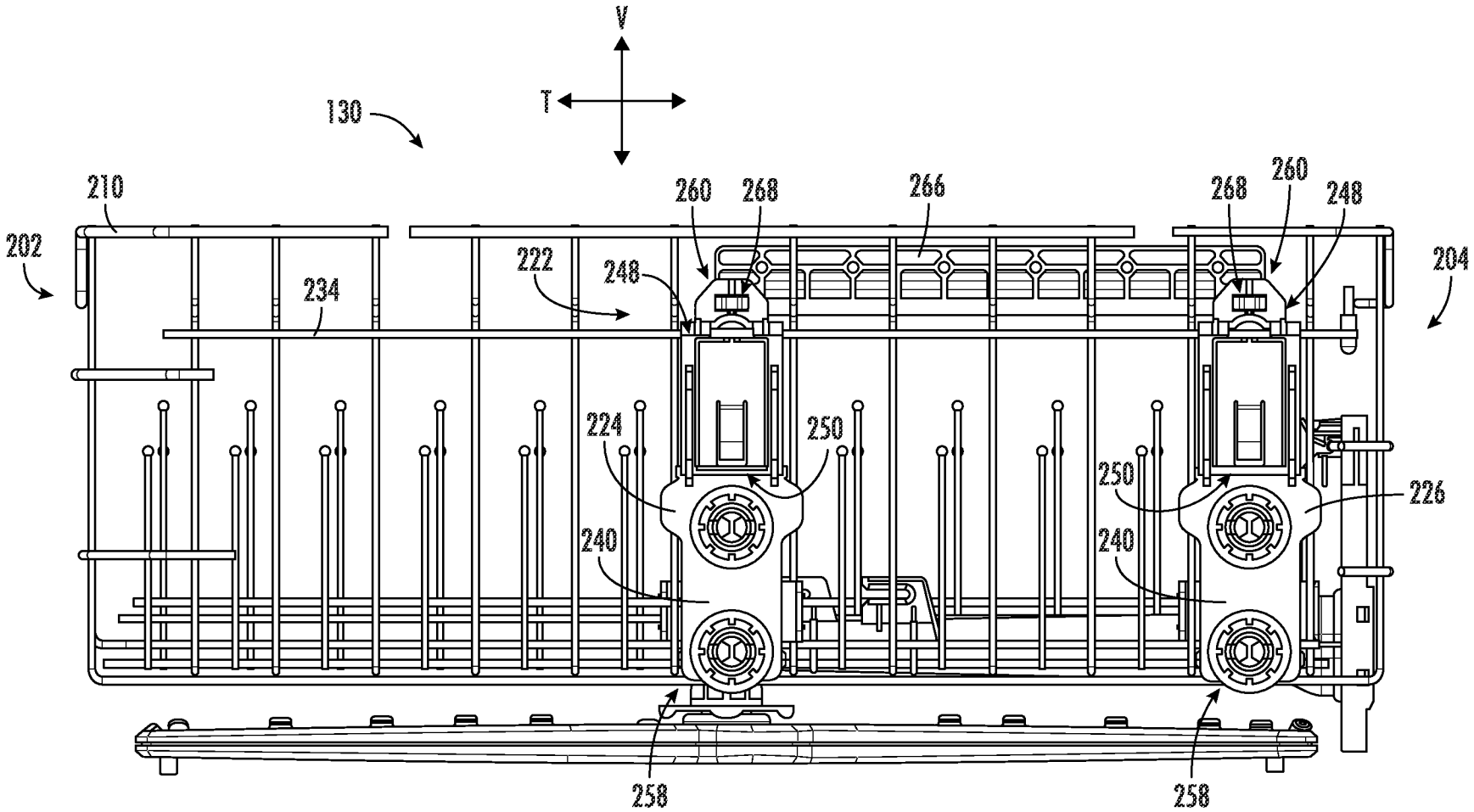
FIG. 6 provides a side elevation view of the exemplary rack assembly of FIG. 3, the rack assembly being in a raised position.
Figure 7:
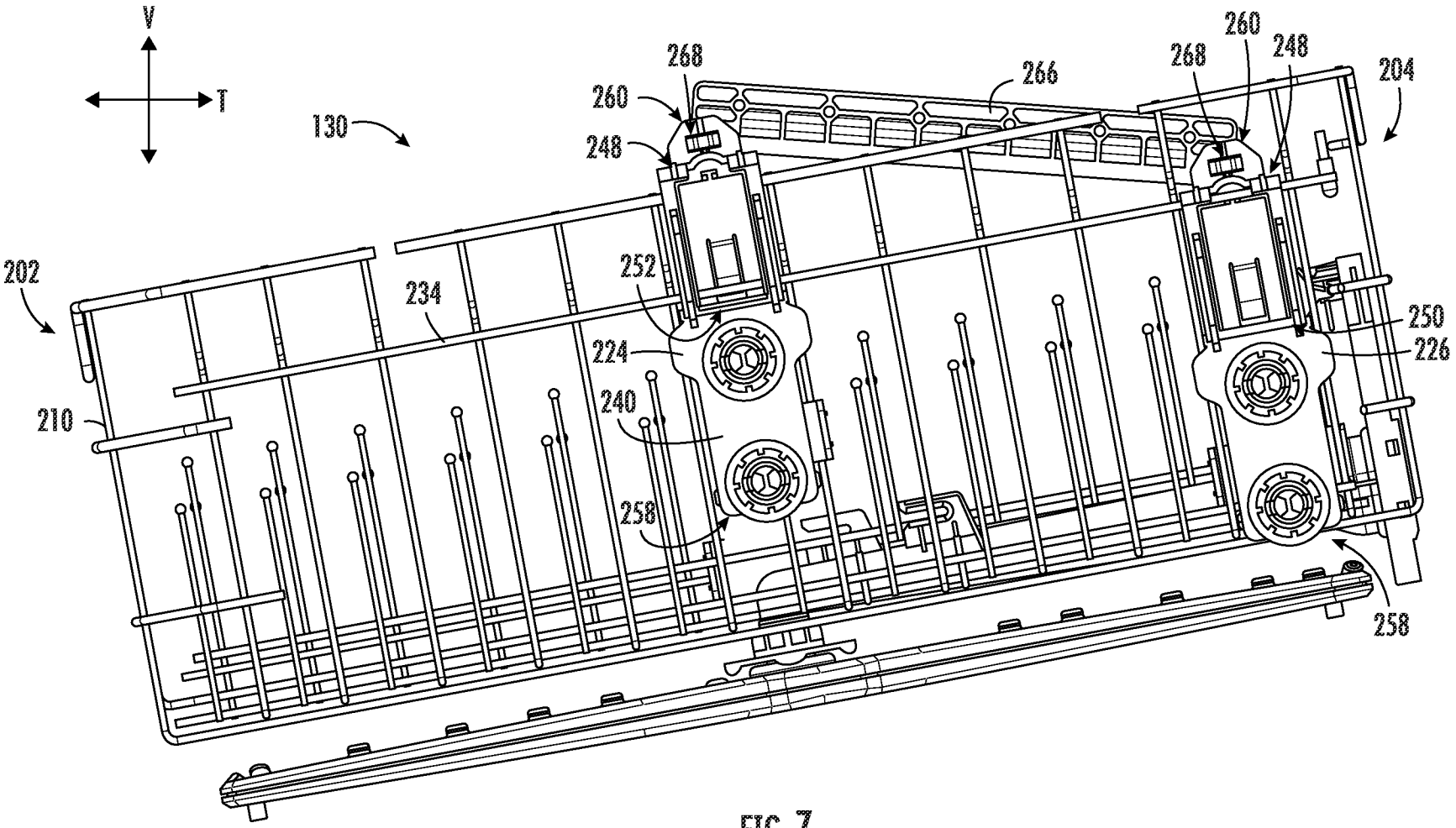
FIG. 7 provides a side elevation view of the exemplary rack assembly of FIG. 3, the rack assembly being in a tilted position.

Turning especially to FIGS. 2 through 7, FIGS. 3 through 7 provide various views of an exemplary rack assembly 130 (e.g., rack assembly 130) having a dish rack 210 according to an exemplary embodiment of the present disclosure. In particular, FIG. 3 provides a partial, perspective view of rack assembly 130. FIG. 4 provides a sectional elevation view along a sidewall 212 of the dish rack 210. FIG. 5 provides a side elevation view of rack assembly 130 with the dish rack 210 in a lowered position. FIG. 6 provides a side elevation view of rack assembly 130 with the dish rack 210 in a raised position. FIG. 7 provides a side elevation view of rack assembly 130 with the dish rack 210 in a tilted position between the lowered and raised positions.

As noted above, rack assembly 130 includes a front bracket 224 attached to a corresponding sidewall 212. For instance, front bracket 224 may be secured to transverse rail 234. In some such embodiments, transverse rail 234 is received within a guide slot 242 defined by front bracket 224. Optionally, guide slot 242 of front bracket 224 may be defined between an outer arm 244 and an inner arm 246 (e.g., both extending vertically from bracket body 240). Guide slot 242 of front bracket 224 may generally extend along the vertical direction V between an upper limit 248 and a lower limit 250. Between the upper and lower limits 248, 250 of front bracket 224; transverse rail 234 may be permitted to move or slide along the vertical direction V. Optionally, a notch or support shelf 254 of front bracket 224 may laterally extend into or from the guide slot 242 of front bracket 224 proximal to the upper limit 248 (i.e., distal to the lower limit 250). Front bracket 224 may include support shelf 254 directly below the upper limit 248 thereof. For instance, support shelf 254 of front bracket 224 may extend laterally inwards (e.g., towards rack cavity 218) from outer arm 244. Generally, support shelf 254 of front bracket 224 defines a shelf surface 254 that faces upwards towards upper limit 248 (i.e., away from lower limit 250). Optionally, a sloped surface 256 may extend generally downward from shelf surface 254 (e.g., at an acute angle relative to the vertical direction V) to permit the transverse rail 234 to slide therealong (e.g., as the dish rack 210 moves vertically upward) while also motivating the support shelf 254 of front bracket 224 laterally outward until the transverse rail 234 exceeds the height of the support shelf 254, similar to a cam. Thus, in certain positions (e.g., in a raised position) transverse rail 234 may rest on support shelf 254 of front bracket 224. In other positions (e.g., a lowered or tilted position) transverse rail 234 may be disposed below support shelf 254 of front bracket 224, such as within the guide slot 242 on front bracket 224 at the lower limit 250.

In some embodiments, front bracket 224 extends vertically between a fixed end 258 and a free end 260. For instance, fixed end 258 may be defined at a bottom portion of bracket body 240 of front bracket 224 while free end 260 is defined at one of the tabs (e.g., outer arm 244). Generally, fixed end 258 of front bracket 224 is laterally anchored or braced against sidewall 212 while free end 260 of front bracket 224 is movable or pivotable along the lateral direction L. In some embodiments, one or more lateral feet 262 are disposed against an inner surface of sidewall 212. For instance, one or more lateral feet 262 of front bracket 224 may extend along the transverse direction T from bracket body 240 of front bracket 224 inside of rack cavity 218 to engage a vertically-disposed lattice member of sidewall 212. Additionally or alternatively, one or more lateral feet 262 may be disposed against an outer surface of sidewall 212. For instance, one or more lateral feet 262 of front bracket 224 may extend along the transverse direction T from bracket body 240 of front bracket 224 outside of rack cavity 218 to engage a vertically-disposed lattice member of sidewall 212. As shown lateral feet 262 may be formed below guide slot 242.

In the illustrated embodiments of FIGS. 3 through 7, free end 260 of front bracket 224 is disposed within dish rack 210 (i.e., within rack cavity 218). In particular, free end 260 of front bracket 224 is held inward from sidewall 212. During use, free end 260 may thus be pivoted outward towards the corresponding sidewall 212 (e.g., by a user's thumb engagement while one or more of the user's fingers hold dish rack 210 vertically), thereby moving support shelf 254 and clearing guide slot 242 such that transverse rail 234 is permitted to slide (e.g., downward) within front bracket 224. In optional embodiments, sidewall 212 includes an upper rim 264 that extends outward at a top end of dish rack 210 apart from free end 260. Thus, upper rim 264 may define a laterally flared groove within which free end 260 of front bracket 224 may be received (e.g., when free end 260 is pivoted outward).

Returning generally to FIGS. 2 through 7, rack assembly 130 includes a rear bracket 226 attached to a corresponding sidewall 212 (e.g., the same sidewall 212 as front bracket 224). For instance, rear bracket 226 may be secured to transverse rail 234. In some such embodiments, transverse rail 234 is received within a guide slot 242 defined by rear bracket 226. Optionally, guide slot 242 may be defined between an outer arm 244 and an inner arm 246 (e.g., both extending vertically from bracket body 240) of rear bracket 226. Guide slot 242 may generally extend along the vertical direction V between an upper limit 248 and a lower limit 250. Between the upper and lower limits 248, 250; transverse rail 234 may be permitted to move or slide along the vertical direction V within rear bracket 226. Optionally, a notch or support shelf 254 of rear bracket 226 may laterally extend into or from guide slot 242 proximal to the upper limit 248 (i.e., distal to the lower limit 250) of rear bracket 226. Rear bracket 226 may include support shelf 254 directly below the corresponding upper limit 248. For instance, support shelf 254 may extend laterally inwards (e.g., towards rack cavity 218) from outer arm 244 of rear bracket 226. Generally, support shelf 254 of rear bracket 226 defines a shelf surface 254 that faces upwards towards upper limit 248 (i.e., away from lower limit 250). Optionally, a sloped surface 256 may extend generally downward from shelf surface 254 of rear bracket 226 (e.g., at an acute angle relative to the vertical direction V) to permit the transverse rail 234 to slide therealong (e.g., as the dish rack 210 moves vertically upward) while also motivating the support shelf 254 laterally outward until the transverse rail 234 exceeds the height of the support shelf 254, similar to a cam. Thus, in certain positions (e.g., in a raised position) transverse rail 234 may rest on support shelf 254 of rear bracket 226. In other positions (e.g., a lowered or tilted position) transverse rail 234 may be disposed below support shelf 254, such as within the guide slot 242 on rear bracket 226 at the lower limit 250 of rear bracket 226.

In some embodiments, rear bracket 226 extends vertically between a fixed end 258 and a free end 260. For instance, fixed end 258 of rear bracket 226 may be defined at a bottom portion of bracket body 240 while free end 260 of rear bracket 226 is defined at one of the tabs (e.g., outer arm 244) Generally, fixed end 258 of rear bracket 226 is laterally anchored or braced against sidewall 212 while free end 260 of lateral bracket 226 is movable or pivotable along the lateral direction L. In some embodiments, one or more lateral feet 262 of rear bracket 226 are disposed against an inner surface of sidewall 212. For instance, one or more lateral feet 262 may extend along the transverse direction T from bracket body 240 of rear bracket 226 to engage a vertically-disposed lattice member of sidewall 212. Additionally or alternatively, one or more lateral feet 262 of rear bracket 226 may be disposed against an outer surface of sidewall 212. For instance, one or more lateral feet 262 may extend along the transverse direction T from bracket body 240 of rear bracket 226 outside of rack cavity 218 to engage a vertically-disposed lattice member of sidewall 212. As shown lateral feet 262 may be formed below guide slot 242 of rear bracket 226.

In the illustrated embodiments of FIGS. 3 through 7, free end 260 of rear bracket 226 is disposed within dish rack 210 (i.e., within rack cavity 218). In particular, free end 260 of rear bracket 226 is held inward from sidewall 212. During use, free end 260 of rear bracket 226 may thus be pivoted outward towards the corresponding sidewall 212 (e.g., by a user's thumb engagement while one or more of the user's fingers hold dish rack 210 vertically), thereby moving support shelf 254 and clearing guide slot 242 such that transverse rail 234 is permitted to slide (e.g., downward) within rear bracket 226. In optional embodiments, sidewall 212 includes an upper rim 264 that extends outward at a top end of dish rack 210 apart from free end 260 of rear bracket 226. Thus, upper rim 264 may define a laterally flared groove within which free end 260 of rear bracket 226 may be received (e.g., when free end 260 is pivoted outward).

As shown in FIGS. 2 through 7, bracket assembly 222 further includes a joiner bar 266 that extends along the transverse direction T from the front bracket 224 to the rear bracket 226. In the illustrated embodiments of FIGS. 3 through 7, joiner bar 266 is disposed within dish rack 210 (i.e., within rack cavity 218). In some embodiments, joiner bar 266 is joined to front bracket 224 proximal to the free end 260 thereof. Thus, joiner bar 266 may be vertically offset from the fixed end 258 of front bracket 224. Generally, joiner bar 266 is laterally translatable relative to sidewall 212. Specifically, joiner bar 266 is able to move laterally with the free end 260 of front bracket 224. In turn, joiner bar 266 may motivate the free end 260 of front bracket 224 according to lateral translation of joiner bar 266. Lateral force provided at the joiner bar 266 (e.g., by a user gripping or engaging joiner bar 266) may thus be transferred to the free end 260 of front bracket 224, permitting both joiner bar 266 and the free end 260 of front bracket 224 to move laterally outward (e.g., away from rack cavity 218).

Additionally or alternatively, joiner bar 266 may be joined to rear bracket 226 proximal to the free end 260 thereof. Thus, joiner bar 266 may be vertically offset from the fixed end 258 of rear bracket 226. Similar to the relationship with front bracket 224, joiner bar 266 is able to move laterally with the free end 260 of rear bracket 226. In turn, joiner bar 266 may motivate the free end 260 of rear bracket 226 according to lateral translation of joiner bar 266. Lateral force provided at the joiner bar 266 (e.g., by a user gripping or engaging joiner bar 266) may thus be transferred to the free end 260 of rear bracket 226, permitting both joiner bar 266 and the free end 260 of rear bracket 226 to move laterally outward (e.g., away from rack cavity 218). When assembled, the rear bracket 226 may be engaged via joiner bar 266 separate or independently from front bracket 224. A user may engage a portion of joiner bar 266 proximal to front bracket 224 to only move the free end 260 of front bracket 224 (e.g., to move dish rack 210 to a tilted position). Thus, the free ends 260 of front and rear brackets 224, 226 may be laterally translatable with joiner bar 266 independent of each other.

In certain embodiments, rear bracket 226 defines a pivot aperture 268 at the free end 260 of rear bracket 226. Joiner bar 266 may have a complementary rear prong that is received within the pivot aperture 268 of rear bracket 226. In particular, the rear prong of joiner bar 266 may be pivotably received within the pivot aperture 268 of rear bracket 226. In turn, a front end of joiner bar 266 (i.e., the end joined to front bracket 224) may be able to pivot about the pivot aperture 268 of rear bracket 226 and, thus, relative to rear bracket 226.

In optional embodiments, front bracket 224 defines a pivot aperture 268 at the free end 260 of front bracket 224. Joiner bar 266 may have a complementary front prong that is received within the pivot aperture 268 of front bracket 224. In particular, the front prong of joiner bar 266 may be pivotably received within the pivot aperture 268 of front bracket 224. In turn, a rear end of joiner bar 266 (i.e., the end joined to rear bracket 226) may be able to pivot about the pivot aperture 268 of front bracket 224 and, thus, relative to front bracket 224.

Turning especially to FIGS. 5 through 7, when assembled, rack assembly 130 defines a plurality of positions of the dish rack 210 relative to the vertical direction V. In the illustrated embodiments, a lowered position (FIG. 5) holds dish rack 210 generally perpendicular to the vertical direction V at a first height. Specifically, the transverse rail 234 may rest at the lower limit 250 of guide slot 242 of both front bracket 224 and rear bracket 226. Separately, a raised position (FIG. 6) holds dish rack 210 generally perpendicular to the vertical direction V at a second height that is above the first height. Specifically, the transverse rail 234 may rest on the support shelf 254 of both front bracket 224 and rear bracket 226. Furthermore, a tilted position (FIG. 7) may be defined that holds dish rack 210 at a non-perpendicular angle relative to the vertical direction V. In particular a front end 202 of dish rack 210 may be held below a rear end 204 of dish rack 210. In some such embodiments, the transverse rail 234 may rest at the lower limit 250 of guide slot 242 of front bracket 224 while resting on the support shelf 254 of rear bracket 226.

Advantageously, the above-described bracket assembly 222 may permit greater control or flexibility for adjusting the vertical height or position of dish rack 210. As an example, engagement with joiner bar 266 (e.g., at or near the middle point between front bracket 224 and rear bracket 226) may notably motivate the free ends 260 of both front bracket 224 and rear bracket 226, permitting a user to easily make adjustments to the height of dish rack 210. As an additional or alternative example, engagement with joiner bar 266 (e.g., at or near front bracket 224) may notably only motivate the free end 260 of front bracket 224, permitting dish rack 210 to pivot downward for easy loading or unloading of certain (e.g., oddly-shaped) articles.

Figure 8:
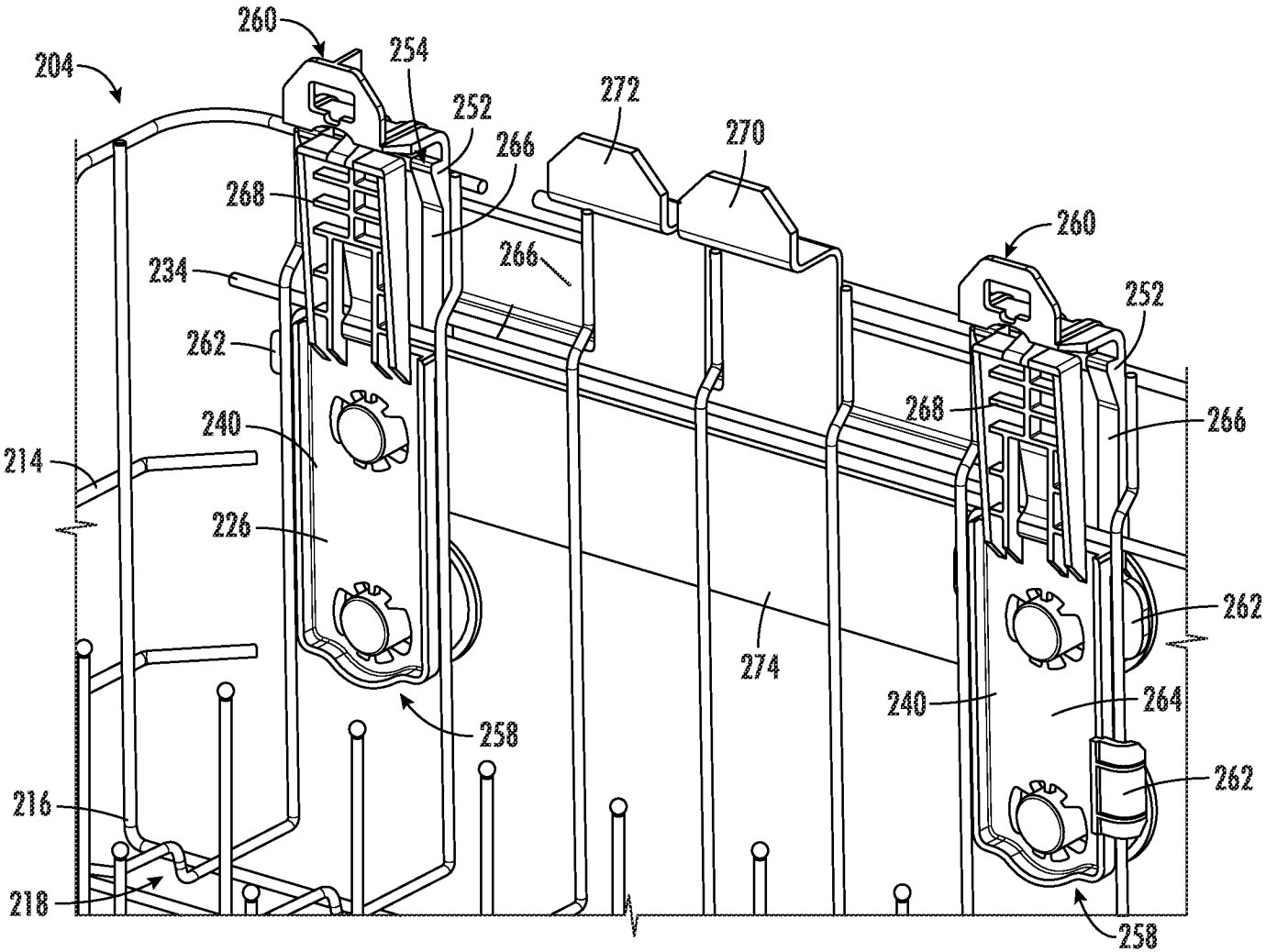
FIG. 8 provides a partial, perspective view of an adjustable rack assembly of an exemplary dishwasher appliance, the rack assembly being in an elevated position.
Figure 9:
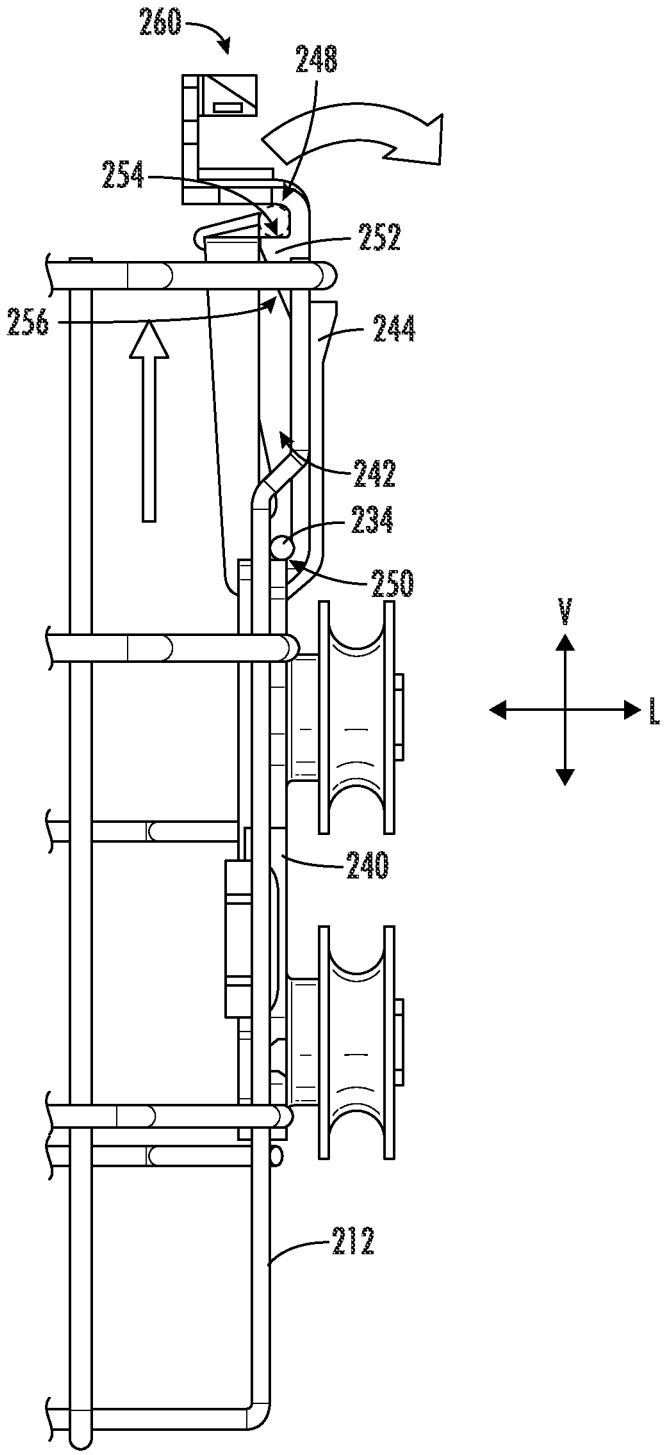
FIG. 9 provides a rear elevation view of a portion of the exemplary rack assembly of FIG. 8.
Figure 10:
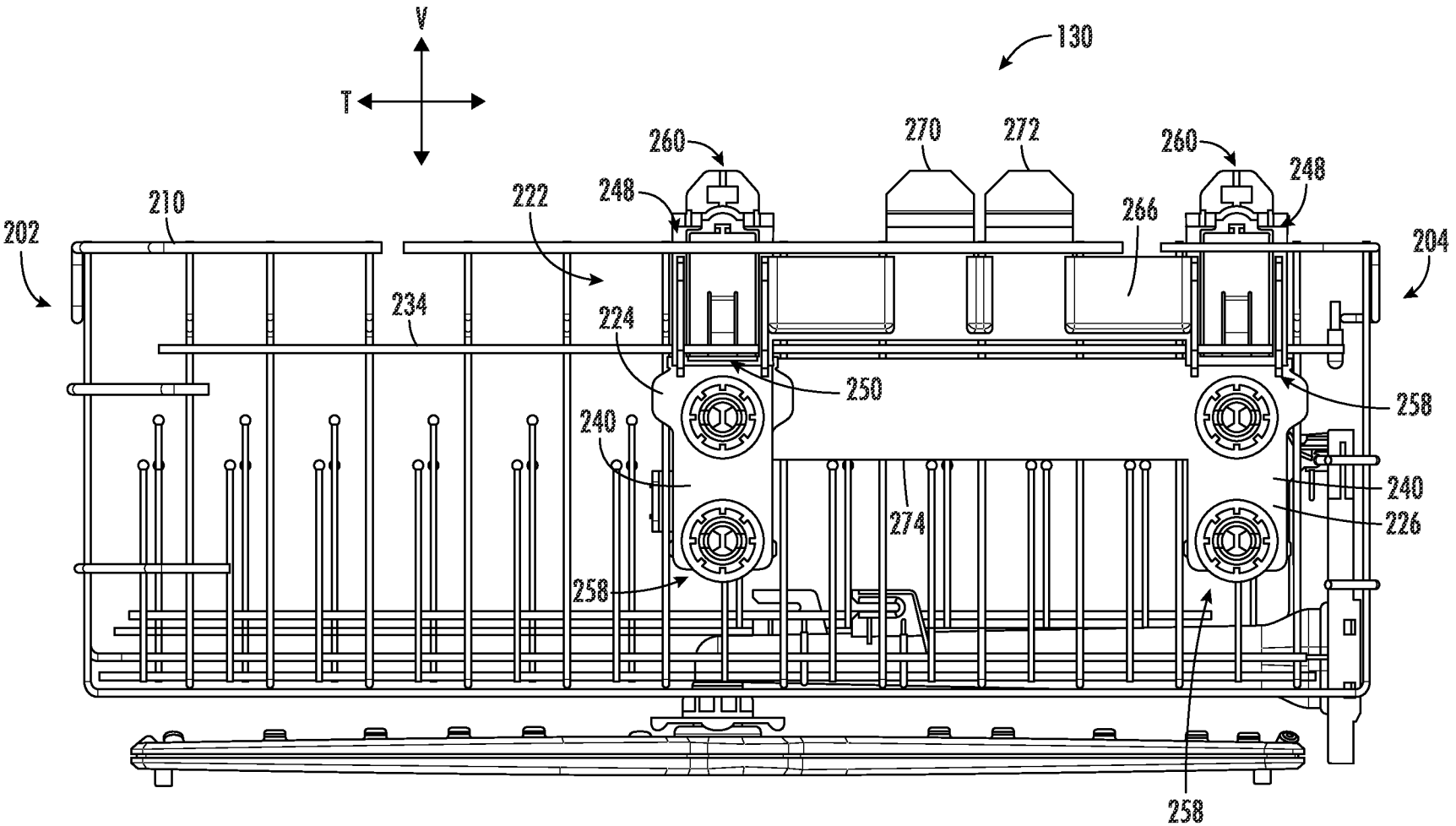
FIG. 10 provides a side elevation view of the exemplary rack assembly of FIG. 8, the rack assembly being in a lowered position.
Figure 11:
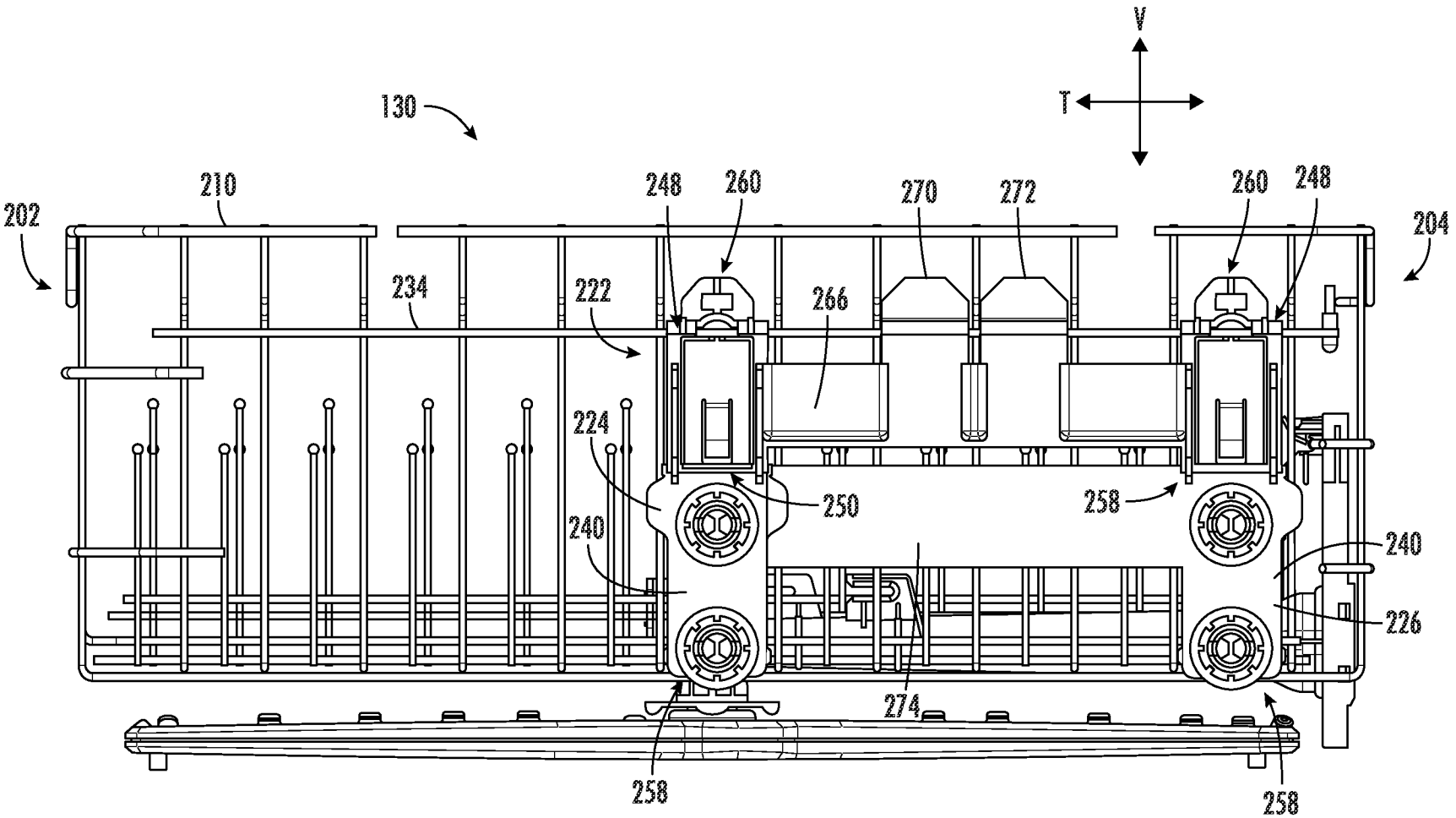
FIG. 11 provides a side elevation view of the exemplary rack assembly of FIG. 8, the rack assembly being in a raised position.
Figure 12:
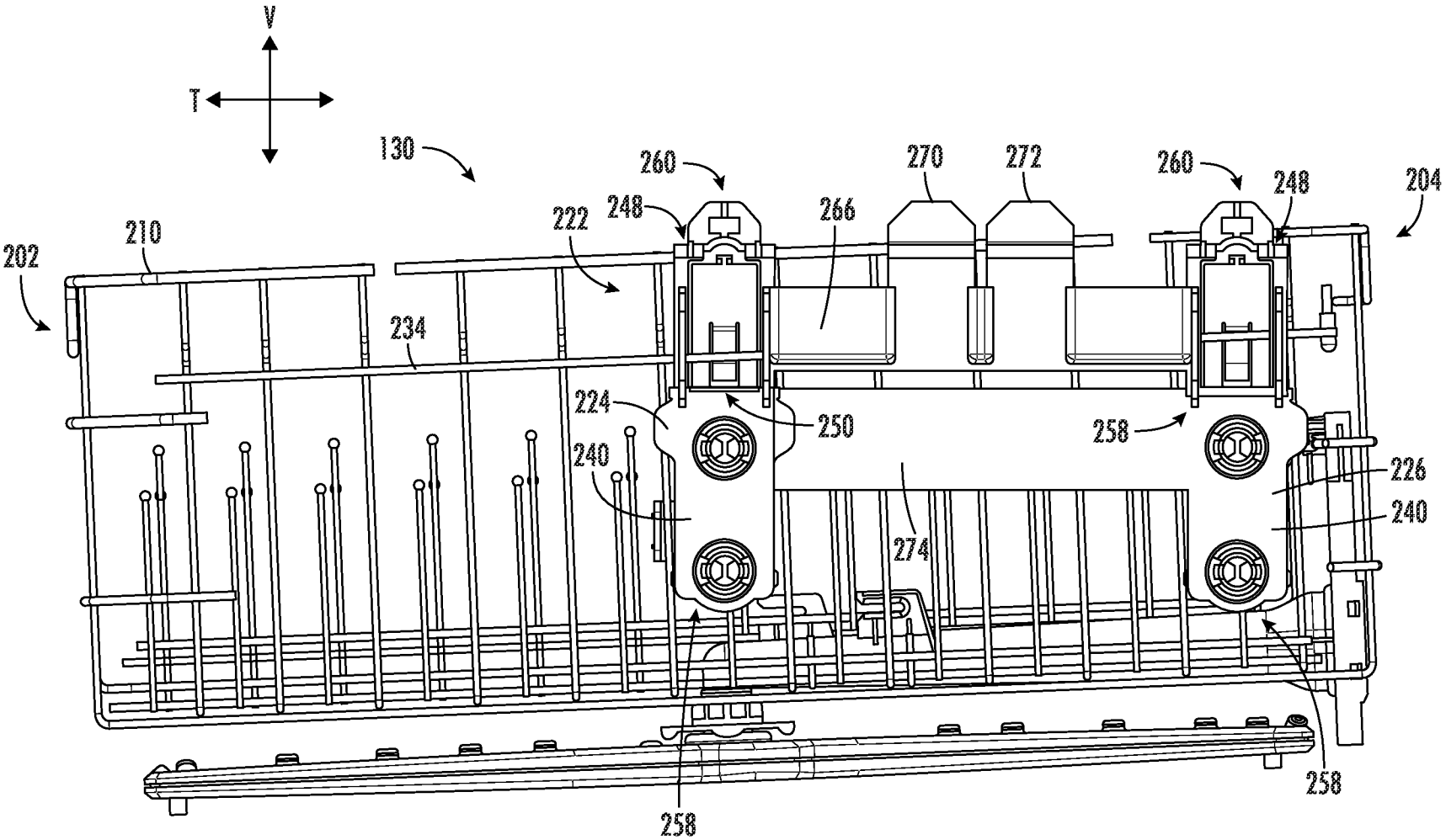
FIG. 12 provides a side elevation view of the exemplary rack assembly of FIG. 8, the rack assembly being in a tilted position.

Turning now to FIGS. 2 and 8 through 12, FIGS. 8 through 12 provide various views of an exemplary rack assembly 130 (e.g., rack assembly 130) having a dish rack 210 according to an exemplary embodiment of the present disclosure. In particular, FIG. 8 provides a partial, perspective view of rack assembly 130. FIG. 9 provides a rear elevation view along a sidewall 212 of the dish rack 210. FIG. 10 provides a side elevation view of rack assembly 130 with the dish rack 210 in a lowered position. FIG. 11 provides a side elevation view of rack assembly 130 with the dish rack 210 in a raised position. FIG. 12 provides a side elevation view of rack assembly 130 with the dish rack 210 in a tilted position between the lowered and raised positions.

As noted above, rack assembly 130 includes a front bracket 224 attached to a corresponding sidewall 212. For instance, front bracket 224 may be secured to transverse rail 234. In some such embodiments, transverse rail 234 is received within a guide slot 242 defined by front bracket 224. Optionally, guide slot 242 of front bracket 224 may be defined between an outer arm 244 and an inner arm 246 (e.g., both extending vertically from bracket body 240). Guide slot 242 of front bracket 224 may generally extend along the vertical direction V between an upper limit 248 and a lower limit 250. Between the upper and lower limits 248, 250 of front bracket 224; transverse rail 234 may be permitted to move or slide along the vertical direction V. Optionally, a notch or support shelf 254 of front bracket 224 may laterally extend into or from the guide slot 242 of front bracket 224 proximal to the upper limit 248 (i.e., distal to the lower limit 250). Front bracket 224 may include support shelf 254 directly below the upper limit 248 thereof. For instance, support shelf 254 of front bracket 224 may extend laterally inwards (e.g., towards rack cavity 218) from outer arm 244. Generally, support shelf 254 of front bracket 224 defines a shelf surface 254 that faces upwards towards upper limit 248 (i.e., away from lower limit 250). Optionally, a sloped surface 256 may extend generally downward from shelf surface 254 (e.g., at an acute angle relative to the vertical direction V) to permit the transverse rail 234 to slide therealong (e.g., as the dish rack 210 moves vertically upward) while also motivating the support shelf 254 of front bracket 224 laterally outward until the transverse rail 234 exceeds the height of the support shelf 254, similar to a cam. Thus, in certain positions (e.g., in a raised position) transverse rail 234 may rest on support shelf 254 of front bracket 224. In other positions (e.g., a lowered or tilted position) transverse rail 234 may be disposed below support shelf 254 of front bracket 224, such as within the guide slot 242 on front bracket 224 at the lower limit 250.

In some embodiments, front bracket 224 extends vertically between a fixed end 258 and a free end 260. For instance, fixed end 258 may be defined at a bottom portion of bracket body 240 of front bracket 224 while free end 260 is defined at one of the tabs (e.g., outer arm 244). Generally, fixed end 258 of front bracket 224 is laterally anchored or braced against sidewall 212 while free end 260 of front bracket 224 is movable or pivotable along the lateral direction L. In some embodiments, one or more lateral feet 262 are disposed against an inner surface of sidewall 212. For instance, one or more lateral feet 262 of front bracket 224 may extend along the transverse direction T from bracket body 240 of front bracket 224 inside of rack cavity 218 to engage a vertically-disposed lattice member of sidewall 212. Additionally or alternatively, one or more lateral feet 262 may be disposed against an outer surface of sidewall 212. For instance, one or more lateral feet 262 of front bracket 224 may extend along the transverse direction T from bracket body 240 of front bracket 224 outside of rack cavity 218 to engage a vertically-disposed lattice member of sidewall 212. As shown lateral feet 262 may be formed below guide slot 242.

In the illustrated embodiments of FIGS. 8 through 12, free end 260 of front bracket 224 is disposed within dish rack 210 (i.e., within rack cavity 218). In particular, free end 260 of front bracket 224 is held inward from sidewall 212. During use, free end 260 may thus be pivoted outward towards the corresponding sidewall 212 (e.g., by a user's thumb engagement while one or more of the user's fingers hold dish rack 210 vertically), thereby moving support shelf 254 and clearing guide slot 242 such that transverse rail 234 is permitted to slide (e.g., downward) within front bracket 224. In optional embodiments, sidewall 212 includes an upper rim 264 that extends outward at a top end of dish rack 210 apart from free end 260. Thus, upper rim 264 may define a laterally flared groove within which free end 260 of front bracket 224 may be received (e.g., when free end 260 is pivoted outward).

Rack assembly 130 includes a rear bracket 226 attached to a corresponding sidewall 212 (e.g., the same sidewall 212 as front bracket 224). For instance, rear bracket 226 may be secured to transverse rail 234. In some such embodiments, transverse rail 234 is received within a guide slot 242 defined by rear bracket 226. Optionally, guide slot 242 may be defined between an outer arm 244 and an inner arm 246 (e.g., both extending vertically from bracket body 240) of rear bracket 226. Guide slot 242 may generally extend along the vertical direction V between an upper limit 248 and a lower limit 250. Between the upper and lower limits 248, 250; transverse rail 234 may be permitted to move or slide along the vertical direction V within rear bracket 226. Optionally, a notch or support shelf 254 of rear bracket 226 may laterally extend into or from guide slot 242 proximal to the upper limit 248 (i.e., distal to the lower limit 250) of rear bracket 226. Rear bracket 226 may include support shelf 254 directly below the corresponding upper limit 248. For instance, support shelf 254 may extend laterally inwards (e.g., towards rack cavity 218) from outer arm 244 of rear bracket 226. Generally, support shelf 254 of rear bracket 226 defines a shelf surface 254 that faces upwards towards upper limit 248 (i.e., away from lower limit 250). Optionally, a sloped surface 256 may extend generally downward from shelf surface 254 of rear bracket 226 (e.g., at an acute angle relative to the vertical direction V) to permit the transverse rail 234 to slide therealong (e.g., as the dish rack 210 moves vertically upward) while also motivating the support shelf 254 laterally outward until the transverse rail 234 exceeds the height of the support shelf 254, similar to a cam. Thus, in certain positions (e.g., in a raised position) transverse rail 234 may rest on support shelf 254 of rear bracket 226. In other positions (e.g., a lowered or tilted position) transverse rail 234 may be disposed below support shelf 254, such as within the guide slot 242 on rear bracket 226 at the lower limit 250 of rear bracket 226.

In some embodiments, rear bracket 226 extends vertically between a fixed end 258 and a free end 260. For instance, fixed end 258 of rear bracket 226 may be defined at a bottom portion of bracket body 240 while free end 260 of rear bracket 226 is defined at one of the tabs (e.g., outer arm 244) Generally, fixed end 258 of rear bracket 226 is laterally anchored or braced against sidewall 212 while free end 260 of lateral bracket 226 is movable or pivotable along the lateral direction L. In some embodiments, one or more lateral feet 262 of rear bracket 226 are disposed against an inner surface of sidewall 212. For instance, one or more lateral feet 262 may extend along the transverse direction T from bracket body 240 of rear bracket 226 to engage a vertically-disposed lattice member of sidewall 212.

In the illustrated embodiments of FIGS. 8 through 12, free end 260 of rear bracket 226 is disposed within dish rack 210 (i.e., within rack cavity 218). In particular, free end 260 of rear bracket 226 is held inward from sidewall 212. During use, free end 260 of rear bracket 226 may thus be pivoted outward towards the corresponding sidewall 212 (e.g., by a user's thumb engagement while one or more of the user's fingers hold dish rack 210 vertically), thereby moving support shelf 254 of rear bracket 226 and clearing guide slot 242 such that transverse rail 234 is permitted to slide (e.g., downward) within rear bracket 226. In optional embodiments, sidewall 212 includes an upper rim 264 that extends outward at a top end of dish rack 210 apart from free end 260. Thus, upper rim 264 may define a laterally flared groove within which free end 260 of rear bracket 226 may be received (e.g., when free end 260 is pivoted outward).

As shown in FIGS. 2 and 8 through 12, bracket assembly 222 further includes a joiner bar 266 and an intermediate brace 274 that both extend along the transverse direction T from the front bracket 224 to the rear bracket 226. In the illustrated embodiments of FIGS. 8 through 12, joiner bar 266 and intermediate brace 274 are disposed outside of dish rack 210 (i.e., laterally outward from sidewall 212 and outside of rack cavity 218). In some embodiments, joiner bar 266 is joined to front bracket 224 proximal to the free end 260 thereof. Thus, joiner bar 266 may be vertically offset from the fixed end 258 of front bracket 224. By contrast, intermediate brace 274 may extend between the bracket bodies 240 of front bracket 224 and rear bracket 226 (e.g., in line with the fixed ends 258 of front bracket 224 and rear bracket 226).

Generally, joiner bar 266 is laterally translatable relative to sidewall 212. Specifically, joiner bar 266 is able to move laterally with the free end 260 of front bracket 224. In turn, joiner bar 266 may motivate the free end 260 of front bracket 224 according to lateral translation of joiner bar 266. In some embodiments, a forward tab 270 extends vertically from joiner bar 266 (e.g., as an integral, unitary member therewith). Lateral force provided at the joiner bar 266 (e.g., by a user gripping or engaging forward tab 270) may thus be transferred to the free end 260 of front bracket 224, permitting both joiner bar 266 and the free end 260 of front bracket 224 to move laterally outward (e.g., away from rack cavity 218).

Additionally or alternatively, joiner bar 266 may be joined to rear bracket 226 proximal to the free end 260 thereof. Thus, joiner bar 266 may be vertically offset from the fixed end 258 of rear bracket 226. Similar to the relationship with front bracket 224, joiner bar 266 is able to move laterally with the free end 260 of rear bracket 226. In turn, joiner bar 266 may motivate the free end 260 of rear bracket 226 according to lateral translation of joiner bar 266. In some embodiments, a rearward tab 272 extends vertically from joiner bar 266 (e.g., as an integral, unitary member therewith). As shown, rearward tab 272 is separate or discrete from forward tab 270, rearward from forward tab 270, but adjacent thereto. Lateral force provided at the joiner bar 266 (e.g., by a user gripping or engaging rearward tab 272) may thus be transferred to the free end 260 of rear bracket 226, permitting both joiner bar 266 and the free end 260 of rear bracket 226 to move laterally outward (e.g., away from rack cavity 218). When assembled, the rear bracket 226 may be engaged via joiner bar 266 and rearward tab 272 separate or independently from front bracket 224. A user may engage forward tab 270 to only move the free end 260 of front bracket 224 (e.g., to move dish rack 210 to a tilted position). Thus, the free ends 260 of front and rear brackets 224, 226 may be laterally translatable with joiner bar 266 independent of each other.

Turning especially to FIGS. 10 through 12, when assembled, rack assembly 130 defines a plurality of positions of the dish rack 210 relative to the vertical direction V. In the illustrated embodiments, a lowered position (FIG. 10) holds dish rack 210 generally perpendicular to the vertical direction V at a first height. Specifically, the transverse rail 234 may rest at the lower limit 250 of guide slot 242 of both front bracket 224 and rear bracket 226. Separately, a raised position (FIG. 11) holds dish rack 210 generally perpendicular to the vertical direction V at a second height that is above the first height. Specifically, the transverse rail 234 may rest on the support shelf 254 of both front bracket 224 and rear bracket 226. Furthermore, a tilted position (FIG. 12) may be defined that holds dish rack 210 at a non-perpendicular angle relative to the vertical direction V. In particular a front end 202 of dish rack 210 may be held below a rear end 204 of dish rack 210. In some such embodiments, the transverse rail 234 may rest at the lower limit 250 of guide slot 242 of front bracket 224 while resting on the support shelf 254 of rear bracket 226.

Advantageously, the above-described bracket assembly 222 may permit greater control or flexibility for adjusting the vertical height or position of dish rack 210. As an example, engagement with joiner bar 266 (e.g., at or near the middle point between front bracket 224 and rear bracket 226) may notably motivate the free ends 260 of both front bracket 224 and rear bracket 226, permitting a user to easily make adjustments to the height of dish rack 210. As an additional or alternative example, engagement with joiner bar 266 (e.g., at or near front bracket 224) may notably only motivate the free end 260 of front bracket 224, permitting dish rack 210 to pivot downward for easy loading or unloading of certain (e.g., oddly-shaped) articles.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A rack assembly comprising:

a rack comprising a sidewall having a transverse rail, the rack being slidable in a transverse direction between an extended position and a retracted position;

a front bracket attached to the sidewall, the front bracket extending vertically between a fixed end secured to the sidewall and a free end laterally pivotable apart from the transverse rail to permit vertical movement of a front end the rack relative to the front bracket;

a rear bracket attached to the sidewall rearward from the front bracket, the rear bracket extending vertically from a fixed end secured to the sidewall to a free end laterally pivotable apart from the transverse rail and independently of the front bracket to permit vertical movement of a rear end the rack relative to the rear bracket and apart from the front end;

a first front wheel rotatably mounted to the front bracket;

a second front wheel rotatably mounted to the front bracket and vertically spaced apart from the first front wheel; and a joiner bar extending along the transverse direction from the front bracket to the rear bracket, the joiner bar being vertically offset from the fixed end of the front bracket, the joiner bar being laterally translatable relative to the transverse rail to motivate the free end of the front bracket, wherein the rack assembly defines a plurality of positions of the rack relative to a vertical direction, wherein the plurality of positions comprises a lowered position holding the rack perpendicular to the vertical direction at a first height, a lowered position holding the rack perpendicular to the vertical direction at a second height above the first height, and a tilted position holding the rack at a non-perpendicular angle relative to the vertical direction, the tilted position maintaining the front end of the rack below the rear end.

2. The rack assembly of claim 1, wherein the front bracket defines a guide slot extending along a vertical direction, and wherein the transverse rail is received within the guide slot of the front bracket.

3. The rack assembly of claim 2, wherein the rear bracket defines a guide slot extending along the vertical direction, and wherein the transverse rail is received within the guide slot of the rear bracket.

4. The rack assembly of claim 1, wherein the joiner bar is vertically offset from the fixed end of the rear bracket and fixed thereto to motivate the free end of the rear bracket according to lateral translation of the joiner bar.

5. The rack assembly of claim 4, wherein the free end of the front bracket is laterally translatable with the joiner bar, and wherein the free end of the rear bracket is laterally translatable with the joiner bar independent of the free end of the front bracket.

6. The rack assembly of claim 1, wherein the rear bracket defines a pivot aperture at the free end of the rear bracket, and wherein the joiner bar is pivotably received within the pivot aperture of the rear bracket.

7. The rack assembly of claim 6, wherein the front bracket defines a pivot aperture at the free end of the front bracket, and wherein the joiner bar is pivotably received within the pivot aperture of the front bracket.

8. The rack assembly of claim 1, wherein the free ends of the front and rear brackets are received within the rack.

9. A dishwashing appliance defining a mutually-perpendicular vertical direction, transverse direction, and lateral direction, the dishwashing appliance comprising:

a cabinet;

a tub defining a wash chamber within the cabinet; and an elevated rack assembly mounted to the tub, the elevated rack assembly comprising a frame positioned within the wash chamber, a rack comprising a sidewall having a transverse rail, the rack being mounted to the frame to receive articles for washing, the rack being slidable along the frame in the transverse direction between an extended position and a retracted position, a front bracket attached to the sidewall, the front bracket supporting the rack on the frame, the front bracket extending vertically between a fixed end secured to the sidewall and a free end laterally pivotable apart from the transverse rail to permit vertical movement of a front end the rack relative to the front bracket, a rear bracket attached to the sidewall rearward from the front bracket, the rear bracket supporting the rack on the frame, the rear bracket extending vertically from a fixed end secured to the sidewall to a free end laterally pivotable apart from the transverse rail and independently of the front bracket to permit vertical movement of a rear end the rack relative to the rear bracket and apart from the front end, a first front wheel rotatably mounted to the front bracket and disposed above the frame, a second front wheel rotatably mounted to the front bracket and disposed below the frame, and a joiner bar extending along the transverse direction from the front bracket to the rear bracket, the joiner bar being vertically offset from the fixed end of the front bracket, the joiner bar being laterally translatable relative to the transverse rail to motivate the free end of the front bracket, wherein the rack assembly defines a plurality of positions of the rack relative to a vertical direction, wherein the plurality of positions comprises a lowered position holding the rack perpendicular to the vertical direction at a first height, a lowered position holding the rack perpendicular to the vertical direction at a second height above the first height, and a tilted position holding the rack at a non-perpendicular angle relative to the vertical direction, the tilted position maintaining a front end of the rack below a rear end.

10. The dishwashing appliance of claim 9, wherein the front bracket defines a guide slot extending along a vertical direction, and wherein the transverse rail is received within the guide slot of the front bracket.

11. The dishwashing appliance of claim 10, wherein the rear bracket defines a guide slot extending along the vertical direction, and wherein the transverse rail is received within the guide slot of the rear bracket.

12. The dishwashing appliance of claim 9, wherein the joiner bar is vertically offset from the fixed end of the rear bracket and fixed thereto to motivate the free end of the rear bracket according to lateral translation of the joiner bar.

13. The dishwashing appliance of claim 12, wherein the free end of the front bracket is laterally translatable with the joiner bar, and wherein the free end of the rear bracket is laterally translatable with the joiner bar independent of the free end of the front bracket.

14. The dishwashing appliance of claim 9, wherein the rear bracket defines a pivot aperture at the free end of the rear bracket, and wherein the joiner bar is pivotably received within the pivot aperture of the rear bracket.

15. The dishwashing appliance of claim 14, wherein the front bracket defines a pivot aperture at the free end of the front bracket, and wherein the joiner bar is pivotably received within the pivot aperture of the front bracket.

16. The dishwashing appliance of claim 9, wherein the free ends of the front and rear brackets are received within the rack.

17. A rack assembly comprising:

a rack comprising a sidewall having a transverse rail, the rack being slidable in a transverse direction between an extended position and a retracted position;

a front bracket attached to the sidewall, the front bracket extending vertically between a fixed end secured to the sidewall and a free end laterally pivotable apart from the transverse rail to permit vertical movement of a front end the rack relative to the front bracket;

a rear bracket attached to the sidewall rearward from the front bracket, the rear bracket extending vertically from a fixed end secured to the sidewall to a free end laterally pivotable apart from the transverse rail and independently of the front bracket to permit vertical movement of a rear end the rack relative to the rear bracket and apart from the front end; and a joiner bar extending along the transverse direction from the front bracket to the rear bracket, the joiner bar being vertically offset from the fixed end of the front bracket, the joiner bar being laterally translatable relative to the transverse rail to motivate the free end of the front bracket, wherein the rack assembly defines a plurality of positions of the rack relative to a vertical direction, wherein the plurality of positions comprises a lowered position holding the rack perpendicular to the vertical direction at a first height, a lowered position holding the rack perpendicular to the vertical direction at a second height above the first height, and a tilted position holding the rack at a non-perpendicular angle relative to the vertical direction, the tilted position maintaining the front end of the rack below the rear end.

18. The rack assembly of claim 17, wherein the front bracket defines a guide slot extending along a vertical direction, and wherein the transverse rail is received within the guide slot of the front bracket, and wherein the rear bracket defines a guide slot extending along the vertical direction, and wherein the transverse rail is received within the guide slot of the rear bracket.

19. The rack assembly of claim 17, wherein the joiner bar is vertically offset from the fixed end of the rear bracket and fixed thereto to motivate the free end of the rear bracket according to lateral translation of the joiner bar, wherein the free end of the front bracket is laterally translatable with the joiner bar, and wherein the free end of the rear bracket is laterally translatable with the joiner bar independent of the free end of the front bracket.

20. The rack assembly of claim 17, wherein the rear bracket defines a pivot aperture at the free end of the rear bracket, and wherein the joiner bar is pivotably received within the pivot aperture of the rear bracket, wherein the front bracket defines a pivot aperture at the free end of the front bracket, and wherein the joiner bar is pivotably received within the pivot aperture of the front bracket.

* * * * *